US010442100B2

(12) United States Patent
Yore, Jr. et al.

(10) Patent No.: US 10,442,100 B2
(45) Date of Patent: Oct. 15, 2019

(54) TRAVELLING PLANETARY CUTTER

(71) Applicant: IPEG, Inc., Cranberry Township, PA (US)

(72) Inventors: Robert G. Yore, Jr., Midland, MI (US); David H. Czarnik, Twining, MI (US); Derik Gingery, Sanford, MI (US); Robert Henry Bessemer, Pinconning, MI (US); Shawn Hitz, Bay City, MI (US)

(73) Assignee: IPEG, Inc., Cranberry Township, PA (US)

( * ) Notice: Subject to any disclaimer, the term of this patent is extended or adjusted under 35 U.S.C. 154(b) by 0 days.

(21) Appl. No.: 16/006,477

(22) Filed: Jun. 12, 2018

(65) Prior Publication Data

US 2019/0134836 A1 May 9, 2019

Related U.S. Application Data

(60) Provisional application No. 62/518,508, filed on Jun. 12, 2017.

(51) Int. Cl.

| | |
|---|---|
| ***B26D 3/16*** | (2006.01) |
| ***B26D 1/60*** | (2006.01) |
| ***B26D 1/56*** | (2006.01) |
| *B26D 5/00* | (2006.01) |

(52) U.S. Cl.

CPC ..... *B26D 3/16* (2013.01); *B26D 1/56* (2013.01); *B26D 1/60* (2013.01); *B26D 5/005* (2013.01)

(58) Field of Classification Search

CPC ..... B26D 3/16; B26D 1/56; B26D 1/60

See application file for complete search history.

(56) References Cited

U.S. PATENT DOCUMENTS 4,412,876 A * 11/1983 Lerner ..... B26D 3/16 156/212
4,806,187 A * 2/1989 Fujisawa ..... B65B 9/14 156/521
5,970,685 A * 10/1999 Huang ..... B26D 1/305 156/86

(Continued)

*Primary Examiner* — Sean M Michalski
(74) *Attorney, Agent, or Firm* — Paul D. Bangor, Jr. Esquire; Clark Hill PLC

(57) ABSTRACT

A travelling planetary cutter (10), comprising: a cutting head assembly (11) comprising a rotating cutting assembly (30) comprising a blade guide block (32) carrying a cutting blade (34), wherein the blade guide block (32) is disposed for axial movement on a cutting block (33) so that cutting blade (34) may be moved towards and away from bearings (36) disposed on the cutting block (33); a blade cam block (42) also comprising part of the rotating cutting assembly (30) and itself comprising a blade cam (44) defining a cam surface (45), wherein axial movement of blade cam (44) of blade cam block (42) in direction (43) forces cam surface (45) to act upon a bearing (46) on blade guide block (32) to cause blade guide block (32) to move towards a workpiece to be cut (14) until cutting blade (34) engages workpiece (14) against bearings (36) while cutting blade (34) is rotated as part of rotating cutting assembly (30) to cut workpiece (14) wherein a speed of rotation of cutting blade (34) is maintained constant even while a diameter of workpiece (14) being cut decreases.

14 Claims, 3 Drawing Sheets

(56) References Cited

U.S. PATENT DOCUMENTS

| | | | | |
|---|---|---|---|---|
| 7,275,469 | B2 * | 10/2007 | Chen | B26D 3/16 30/101 |
| 8,146,333 | B2 * | 4/2012 | Fresnel | B65B 9/14 53/389.3 |
| 2012/0213937 | A1 * | 8/2012 | LaValley | B26D 3/16 427/401 |
| 2017/0259357 | A1 * | 9/2017 | Choi | B23D 21/00 |
| 2018/0147116 | A1 * | 5/2018 | Stein | B26D 3/16 |

* cited by examiner

TRAVELLING PLANETARY CUTTER

CROSS REFERENCE TO RELATED APPLICATIONS

This application claims the benefit of provisional patent application U.S. Ser. No. 62/518,508 filed Jun. 12, 2017, which is incorporated by reference herein for all purposes.

FIELD OF THE DISCLOSURE

The present disclosure relates to the field of cutting mechanisms, and more particularly to cutting mechanisms adapted for cutting tubing in a process machine.

BACKGROUND OF THE DISCLOSURE

Thin wall plastic tubing has many uses including for over-wrapping product containers, typically bottles, in which products, for example personal hygiene, pharmaceutical or food products, are shipped. The plastic tubing may be applied as a label over a major portion of the container to identify the product and/or enhance the appearance of the container. In another form, the plastic tubing provides a tamper-evident band that covers the container cap and neck, serving to indicate whether the container has been opened after shipping. In many cases the plastic tubing is processed so as to be shrinkable by the application of heat after a cut length of tubing has been placed over the container, and thus the tubing conforms snugly to the contours of the container.

In any such form, the subject plastic tubing labels and tamper-evident bands are applied to product containers in manufacturing environments, therefore process speed, tubing length consistency and neatness of the cut edge are important factors.

Most known machines for the application of thin wall plastic tubing to containers employ a scissor-type double blade cutter or a guillotine-type single blade cutter. Another cutter type is described in U.S. Pat. No. 5,531,858 entitled "Shrinkable Label Inserting Machine" in which a plurality of blades is mounted circumferentially around a passage through which a thin wall plastic tube is conveyed. Each of the blades is mounted rotatably on a wheel that is in contact with a driven band, e.g. a belt or chain. When an appropriate length of tubing has moved through and extends beyond the passage, the band is rotated to cause the blades to swing in plural overlapping arcs, cutting the tubing.

Other cutting machines are described in U.S. Pat. Nos. 7,275,469 and 7,562,611, each entitled "Planetary tubing cutter" wherein a planetary tubing cutter provides a gearing assembly having a pair of ring gears and a number of pinions with a blade affixed to each pinion. The ring gears are parallel to one another and are individually driven. The pinions are rotatably mounted to a side surface of one ring gear and engage a sun gear assembled to the other ring gear. When the ring gears rotate at the same speed, the pinions and blades do not revolve around their respective axes, and when one ring gear rotates at a speed different from the other ring gear, the pinions and blades revolve about their respective axes, intercepting and cutting a tube passing through an axial passage through the ring gears.

A drawback of the above-described cutters is that they don't always provide for clean cuts with a minimum of marks or burrs. Other drawbacks of existing cutting machines include slow cutting speeds and excessive force needed to be exerted against a workpiece. It would therefore be desirable to provide an improved cutter making cleaner cuts with a minimum of marks and burrs at increased cutting speeds not requiring excessive force of the cutting blade against the workpiece being cut.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a travelling planetary cutter (10), comprising: a cutting head assembly (11) comprising a rotating cutting assembly (30) comprising a blade guide block (32) carrying a cutting blade (34), wherein the blade guide block (32) is disposed for axial movement on a cutting block (33) so that cutting blade (34) may be moved towards and away from bearings (36) disposed on the cutting block (33); a blade cam block (42) also comprising part of the rotating cutting assembly (30) and itself comprising a blade cam (44) defining a cam surface (45), wherein axial movement of blade cam (44) of blade cam block (42) in direction (43) forces cam surface (45) to act upon a bearing (46) on blade guide block (32) to cause blade guide block (32) to move towards a workpiece to be cut (14) until cutting blade (34) engages workpiece (14) against bearings (36) while cutting blade (34) is rotated as part of rotating cutting assembly (30) to cut workpiece (14) wherein a speed of rotation of cutting blade (34) is maintained constant even while a diameter of workpiece (14) being cut decreases.

In another aspect of a preferred travelling planetary cutter of the present disclosure, the speed of rotation of cutting blade (34) is maintained constant at a speed of 500 rpms or above.

In a further aspect of a preferred travelling planetary cutter of the present disclosure, the workpiece (14) comprises tubing.

In another aspect of a preferred travelling planetary cutter of the present disclosure, the axial movement of blade cam (44) of blade cam block (42) in direction (43) is caused by a linear actuator (52), powered by a linear servo motor, operating upon a linear movement arm (50) that acts upon the blade cam block (42).

In yet another aspect of a preferred travelling planetary cutter of the present disclosure, the cutting blade (34) is circular.

In another aspect of a preferred travelling planetary cutter of the present disclosure, a constant rotational speed of cutting blade (34) is maintained by adjusting the rotational speed of rotating cutting assembly (30) as the outer diameter of workpiece (14) around the circumferential cut decreases as cutting blade (34) cuts deeper into workpiece (14).

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

Figure 1:
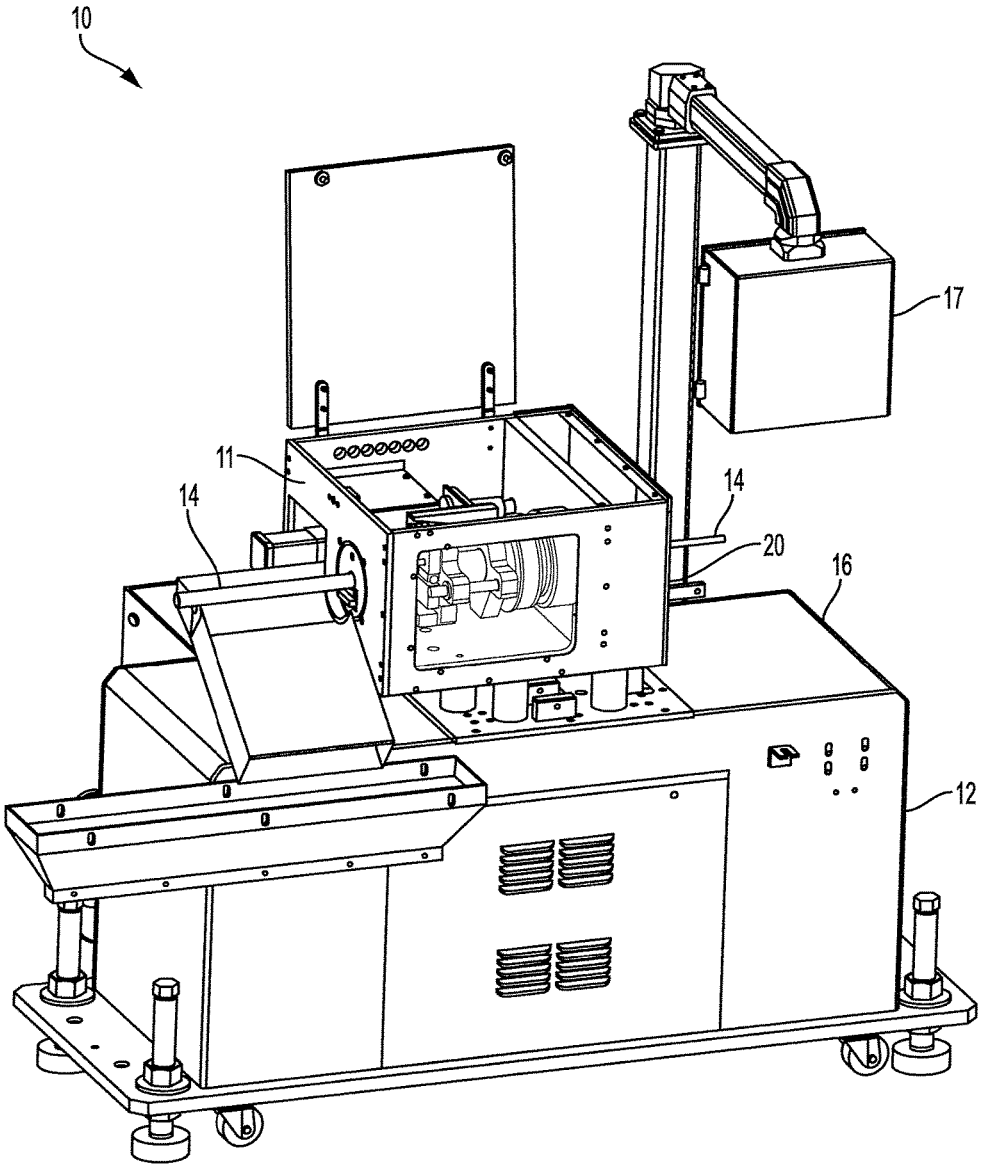
FIG. 1 shows a top perspective view of a preferred planetary cutter of the present disclosure.

In the following detailed description, reference is made to the accompanying examples and figures that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single disclosure or inventive concept if more than one is in fact disclosed.

The following description is, therefore, not to be taken in a limited sense, and the scope of this disclosure is defined by the appended claims.

A preferred planetary cutter 10 of the present disclosure comprises a conveyor table 12 having a means for articulating planetary cutter head assembly 11 back and forth to receive and size tubing 14 to be cut from an extruder or other device (not shown) that feeds tubing 14 to the planetary cutter head assembly 11. Preferably, such means for articulating includes a conveyor belt 16 for moving planetary cutter head assembly 11 in a first direction and mechanical means for moving planetary cutter head assembly 11 in a second direction opposite of the first direction and over top of conveyor belt 16 and for placing planetary cutter head assembly 11 back onto conveyor belt 16 so it can travel with tubing 14 during the cutting of tubing 14 as it is being forced through planetary cutter head assembly 11 during an extrusion process or otherwise.

The planetary cutter 10 further preferably comprises a computer controller (not shown) and a user interface device 17 interacting with the computer controller for controlling the operation of the planetary cutter 10.

Figure 2:
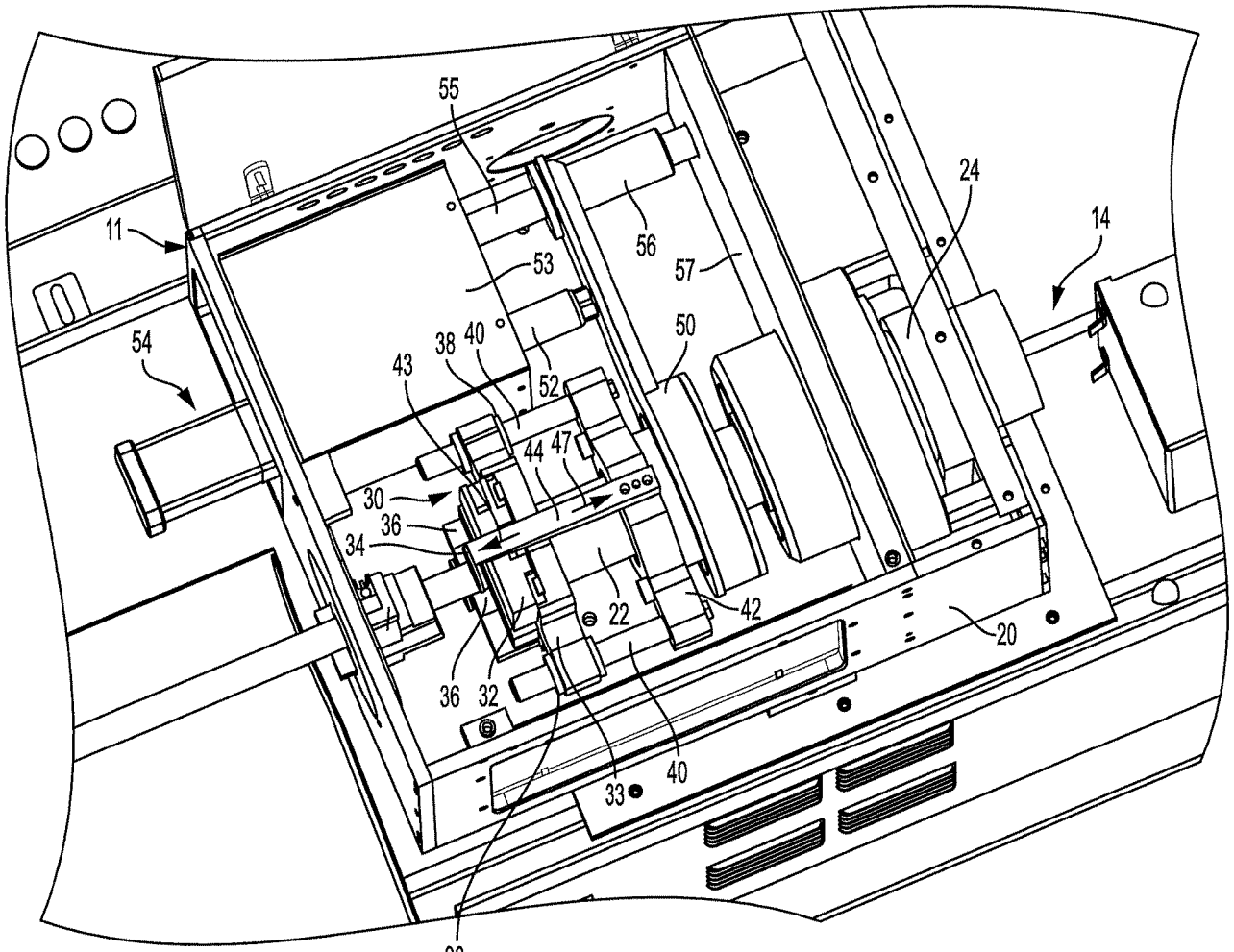
FIG. 2 shows a top perspective view of a preferred planetary cutter head assembly of the planetary cutter of FIG. 1.

Planetary cutter head assembly 11 comprises a housing 20 containing rotatable hollow shaft 22 driven by belt 24 which in turn is driven by a motor (not shown) preferably housed within conveyor table 12 of planetary cutter 10. Tubing 14 to be cut by planetary cutter 10 is received through rotatable hollow shaft 22. Two different size diameters of tubing 14 are shown in FIGS. 1-2 for illustrative purposes only. Preferably, only one size diameter tubing 14 would normally be fed through planetary cutter head assembly 11 at a given time.

Cutting assembly 30 is mounted on rotatable hollow shaft 22 and rotates therewith when shaft 22 is rotated by a motor of the planetary cutter 10 and belt 24. Blade guide block 32 is part of cutting assembly 30 and carries circular cutting blade 34. Blade guide block 32 is preferably mounted for axial movement on cutting block 33 towards and away from bearings 36 also carried by cutting block 33.

Figure 3:
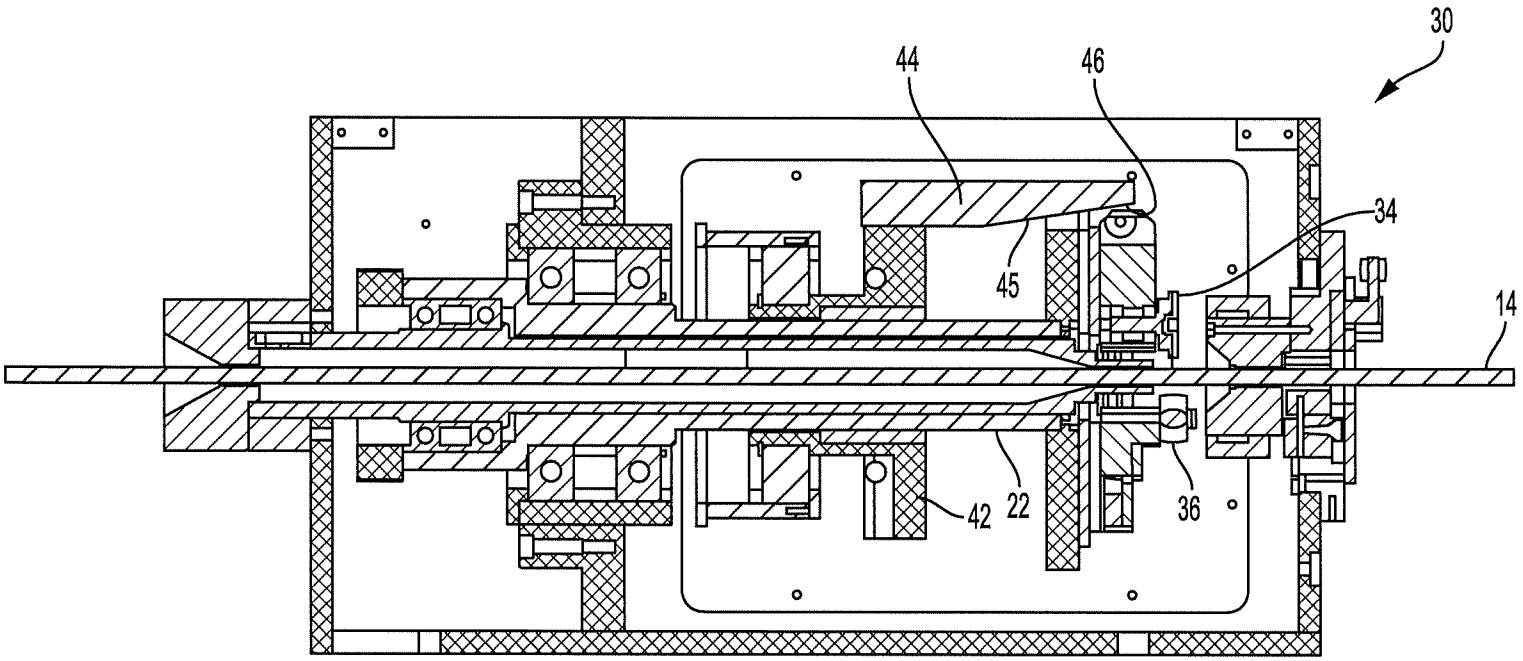
FIG. 3 shows a cross-sectional view of a preferred cutting assembly of the planetary cutter head assembly of FIG. 2.

Cutting block 33 also houses bushings 38 through which guide rods 40 of blade cam block 42 are received for axial movement. Blade cam block 42 carries blade cam 44 mounted thereto. The underside of blade cam 44 has a tapered cam surface 45 (see FIG. 3) that interacts with bearing 46 on blade guide block 32 to articulate blade guide block 32 towards and away from tubing 14; with blade guide block 32 moving towards tubing 14 upon movement of blade cam 44 in direction of arrow 43 and blade guide block 32 moving away from tubing 14 when blade cam 44 moves in direction of arrow 47.

Blade cam block 42 with blade cam 44 is articulated back and forth in directions 43 and 47 by linear movement arm 50, a portion of which defines an opening through which shaft 22 extends. Linear movement arm 50 is moved linearly back and forth by linear actuator 52 connected to linear movement arm 50. Linear actuator 52 is preferably powered by linear servo motor 54, but a ball screw may also be used for such purpose. Linear movement arm 50 also has an opening to receive therethrough a linear guide rod 55 and bushing 56 for guiding linear movement of the linear movement arm 50. Linear guide rod 55 is preferably connected between a wall 57 within housing 11 and servo motor housing 53.

In operation, a length of tubing 14 is moved through rotating cutting assembly 30 of the planetary cutter head assembly 11, whereby axial movement of blade cam 44 of blade cam block 42 in direction 43 caused by linear actuator 52 operating upon linear movement arm 50 forces cam surface 45 to act upon bearing 46 to cause blade guide block 32 to move towards tubing 14 until cutting blade 34 engages tubing 14 against bearings 36 while cutting blade 34 is rotated by motor (not shown) and belt 24 as part of rotating cutting assembly 30 to cut tubing 14. Preferably, the controller of planetary cutter 10 maintains a constant rotational speed of cutting blade 34 by adjusting the rotational speed of rotating cutting assembly 30 as the outer diameter of tubing 14 around the circumferential cut decreases as cutting blade 34 cuts deeper into tubing 14 and factoring in the axial movement of cutting blade 34 towards bearings 36 caused by blade cam 44 as described above. Such constant rotational speed of cutting blade 34 produces a clean cut with a minimum of marks or burrs.

Also, cutting blade 34 is preferably rotated at speeds of about 500 RPM or more by planetary cutter 10 to allow for more cuts to be made in a given period of time and to reduce the force required by cutting blade 34 against the workpiece tubing 14 being cut.

The travelling planetary cutter 10 of the present disclosure is preferably designed to cut rigid plastic tubing, typically from an extrusion process, but it could also be used off line with tubing made in other ways and/or from other materials. Preferably, cutting assembly 30 has computer controlled three-axis movement as well as blade speeds for circular cutting blade 34 exceeding 500 rpm around the workpiece tubing 14 being cut.

It will be readily understood to those skilled in the art that various other changes in the details, components, material, and arrangements of the parts and methods which have been described and illustrated in order to explain the nature of this disclosure may be made without departing from the principles and scope of the disclosure as expressed in the subjoined claims.

In the foregoing description of preferred embodiments of the present disclosure, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the foregoing description, with each claim standing on its own as a separate embodiment.

What is claimed is:

1. A travelling planetary cutter (10), comprising:

a cutting head assembly (11) comprising a rotating cutting assembly (30) comprising a blade guide block (32) carrying a cutting blade (34), wherein the blade guide block (32) is disposed for axial movement on a cutting block (33) so that cutting blade (34) may be moved towards and away from bearings (36) disposed on the cutting block (33);

a blade cam block (42) also comprising part of the rotating cutting assembly (30) and itself comprising a blade cam (44) defining a cam surface (45), wherein axial movement of blade cam (44) of blade cam block (42) in direction (43) forces cam surface (45) to act upon a bearing (46) on blade guide block (32) to cause blade guide block (32) to move towards a workpiece to be cut (14) until cutting blade (34) engages workpiece (14) against bearings (36) while cutting blade (34) is rotated as part of rotating cutting assembly (30) to cut workpiece (14) wherein a speed of rotation of cutting blade (34) is maintained constant even while a diameter of workpiece (14) being cut decreases.

2. The travelling planetary cutter (10) of claim 1 wherein the speed of rotation of cutting blade (34) is maintained constant at a speed of 500 rpms or above.

3. The travelling planetary cutter (10) of claim 2 wherein the axial movement of blade cam (44) of blade cam block (42) in direction (43) is caused by a linear actuator (52), powered by a linear servo motor, operating upon a linear movement arm (50) that acts upon the blade cam block (42).

4. The travelling planetary cutter (10) of claim 2 wherein cutting blade (34) is circular.

5. The travelling planetary cutter (10) of claim 1 wherein the workpiece (14) comprises tubing.

6. The travelling planetary cutter (10) of claim 5 wherein the axial movement of blade cam (44) of blade cam block (42) in direction (43) is caused by a linear actuator (52), powered by a linear servo motor, operating upon a linear movement arm (50) that acts upon the blade cam block (42).

7. The travelling planetary cutter (10) of claim 5 wherein cutting blade (34) is circular.

8. The travelling planetary cutter (10) of claim 1 wherein the axial movement of blade cam (44) of blade cam block (42) in direction (43) is caused by a linear actuator (52), powered by a linear servo motor, operating upon a linear movement arm (50) that acts upon the blade cam block (42).

9. The travelling planetary cutter (10) of claim 8 wherein cutting blade (34) is circular.

10. The travelling planetary cutter (10) of claim 1 wherein cutting blade (34) is circular.

11. The travelling planetary cutter (10) of claim 10 wherein the axial movement of blade cam (44) of blade cam block (42) in direction (43) is caused by a linear actuator (52), powered by a linear servo motor, operating upon a linear movement arm (50) that acts upon the blade cam block (42).

12. The travelling planetary cutter (10) of claim 1 wherein a constant rotational speed of cutting blade (34) is maintained by adjusting the rotational speed of rotating cutting assembly (30) as the outer diameter of workpiece (14) around the circumferential cut decreases as cutting blade (34) cuts deeper into workpiece (14).

13. The travelling planetary cutter (10) of claim 12 wherein the axial movement of blade cam (44) of blade cam block (42) in direction (43) is caused by a linear actuator (52), powered by a linear servo motor, operating upon a linear movement arm (50) that acts upon the blade cam block (42).

14. The travelling planetary cutter (10) of claim 12 wherein cutting blade (34) is circular.

* * * * *